US006031491A

United States Patent [19]

Daniel et al.

[11] Patent Number: 6,031,491

[45] Date of Patent: Feb. 29, 2000

[54] BROADBAND PRINTED ARRAY ANTENNA

[75] Inventors: Jean-Pierre Daniel; Mohamed Himdi, both of Rennes; Daniel Gaudin, Saint Renan; Jean-Pierre David, Brest, all of France

[73] Assignee: Thomson-CSF, Paris, France

[21] Appl. No.: 09/125,110

[22] PCT Filed: Dec. 16, 1997

[86] PCT No.: PCT/FR97/02314

§ 371 Date: Sep. 15, 1998

§ 102(e) Date: Sep. 15, 1998

[87] PCT Pub. No.: WO98/27616

PCT Pub. Date: Jun. 25, 1998

[30] Foreign Application Priority Data

Dec. 12, 1996 [FR] France ..... 96 15510

[51] Int. Cl.[7] ..... H01Q 1/38

[52] U.S. Cl. ..... 343/700 MS; 343/824; 343/853

[58] Field of Search ..... 343/700 MS, 824, 343/853, 814, 815, 816

[56] References Cited

U.S. PATENT DOCUMENTS

| | | | |
|---|---|---|---|
| 4,083,050 | 4/1978 | Hall | 343/729 |
| 4,560,445 | 12/1985 | Hoover et al. | 204/15 |
| 4,686,535 | 8/1987 | Lalezari | 343/700 MS |
| 5,453,754 | 9/1995 | Fray | 343/789 |
| 5,646,634 | 7/1997 | Bokhari et al. | 343/700 MS |
| 5,838,282 | 11/1998 | Lalezari et al. | 343/727 |

*Primary Examiner*—Don Wong
*Assistant Examiner*—James Clinger
*Attorney, Agent, or Firm*—Oblon, Spivak, McClelland, Maier & Neustadt, P.C.

[57] ABSTRACT

A broadband array antenna which delivers an axisymmetric main lobe. The antenna includes patches arranged with an interruption of periodicity in one of the planes and is corner-fed by tree like feed lines from a central point of energization. Opposite each path is a parasitic element for broadening the band. This device can be used in particular with measurement radar.

15 Claims, 12 Drawing Sheets

BROADBAND PRINTED ARRAY ANTENNA

BACKGROUND OF THE INVENTION

1. Field the Invention

The present invention relates to a broadband printed array antenna intended to deliver a substantially axisymmetric main lobe about an axis passing through its centre.

2. Discussion of the Background

It is now well known that, in order to produce compact antennas, a particularly beneficial solution is the use of printed array antennas. Among the various possible types, patch antennas are still hardly used despite their benefit, due to the ease of production using known techniques for fabricating printed circuits.

In certain applications such as, for example, enclosed-space measurement radars, it is particularly important to have a broadband microwave antenna whose radiation pattern is substantially axisymmetric.

Although this can be achieved with conventional types of radiating elements, such as horns etc., the problem encountered is that of an often considerable lack of compactness.

SUMMARY OF THE INVENTION

A subject of the invention is therefore a printed array antenna which is very compact owing to the use of patches and exhibits a substantially axisymmetric pattern over a very broad band.

According to the invention, there is therefore provided a broadband printed array antenna for delivering a substantially axisymmetric main lobe about an axis passing through the centre (A) of the antenna, the said antenna comprising a plurality of substantially square radiating patches fed by microstrip lines, characterized in that the feeding by the said lines from the centre (A) of the antenna is of the tree-like type and in that each patch is fed through a corner by one of the lines which partially overlaps the said corner.

To obtain as clean as possible a radiation pattern, according to another aspect of the invention, there is moreover provision that in at least one direction of the plane of the antenna (E, H, D), the distribution of the patches is not periodic so as to limit the side lobes in the radiation pattern of the antenna and to move aside the array lobes, the patches at the periphery of the antenna in this direction exhibiting a spacing greater than that of the patches towards the centre of the antenna.

BRIEF DESCRIPTION OF THE DRAWINGS

The invention will be better understood and other characteristics and advantages will emerge with the aid of the description below and of the appended drawings in which.

DETAILED DESCRIPTION OF THE PREFERRED EMBODIMENT

Figure 1:
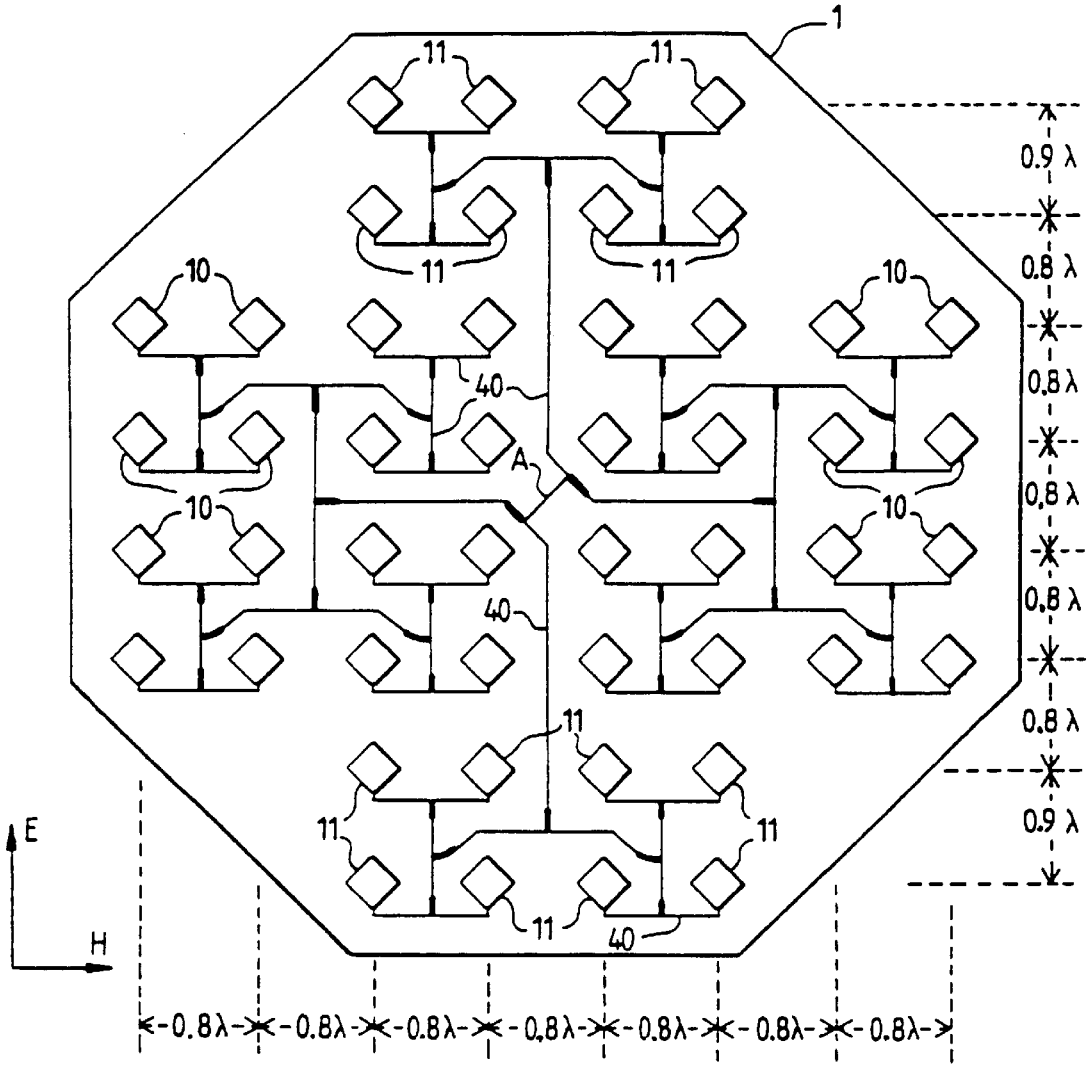
FIG. 1 is a plan view of the antenna according to the invention.

FIG. 1 is a plan view of the antenna according to the invention. This antenna 1 uses an array of patches 10, 11 distributed over a surface which is here bounded by an octagon, although this is in no way limiting. These patches are fed by an array of feed lines 40 from a central point A where the signal is applied, for example by way of a coaxial.

Figure 2:
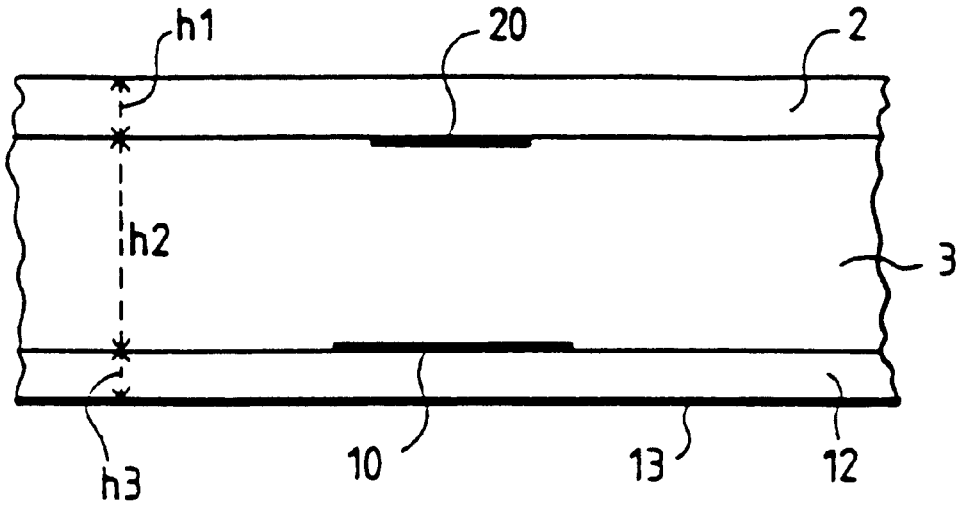
FIG. 2 is a partial sectional view.
Figure 3:
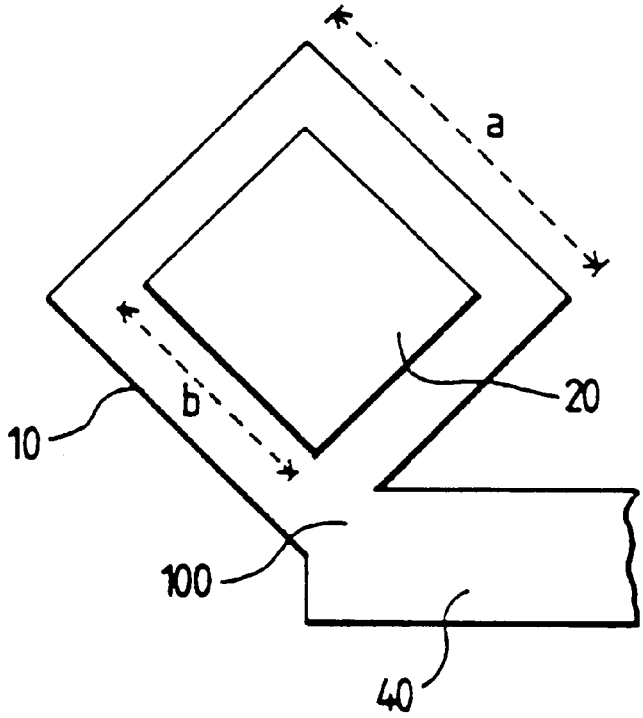
FIG. 3 represents a patch and its feed line.

The structure of the antenna will be better understood with the aid of FIGS. 2 and 3. FIG. 2 is a partial section through the antenna 1. The antenna is made according to the technique of printed circuits and comprises a first dielectric layer 12, made for example from polypropylene, one face of which bears a metallization 13 serving as earth plane and the other face of which comprises the patches 10 (one of them is represented). Applied to the face bearing the patches is a much thicker dielectric foam layer 3 which in turn bears a second dielectric layer 2, made for example from epoxy glass, of which the face in contact with the foam bears parasitic elements 20 opposite each patch 10. These parasitic elements preferably have the same shape as the patches but are of smaller size and make it possible to broaden the passband of the antenna.

The thickness h2 of the dielectric foam layer 3 is preferably three to four times the thickness h3 of the first dielectric layer 12. By virtue of this structure, the second dielectric layer 2 bearing the parasitic elements serves also as radome for the antenna.

The parasitic elements have not been represented in FIG. 1 for the clarity of the drawing.

FIG. 3 shows, in plan view, a patch 10 and its feed. This patch is of square shape, with side a; facing it is the corresponding parasitic element 20, with side b smaller than a. The patch is corner-fed through its corner 100 which is connected to the line 40 at 90° to the diagonal of the patch. The size of the overlap between line and patch makes it possible to adapt in particular the impedance of the assembly. The advantage of corner-feeding with a tree-like feed as presented in FIG. 1 is that in this way an elbow in the line is eliminated for each patch, which, otherwise, would be necessary if the line 40 departed from the corner 100 in the direction of the diagonal of the patch ending at the corner. An appreciable cause of losses due to elbows is thus eliminated from the entire array.

Figure 4:
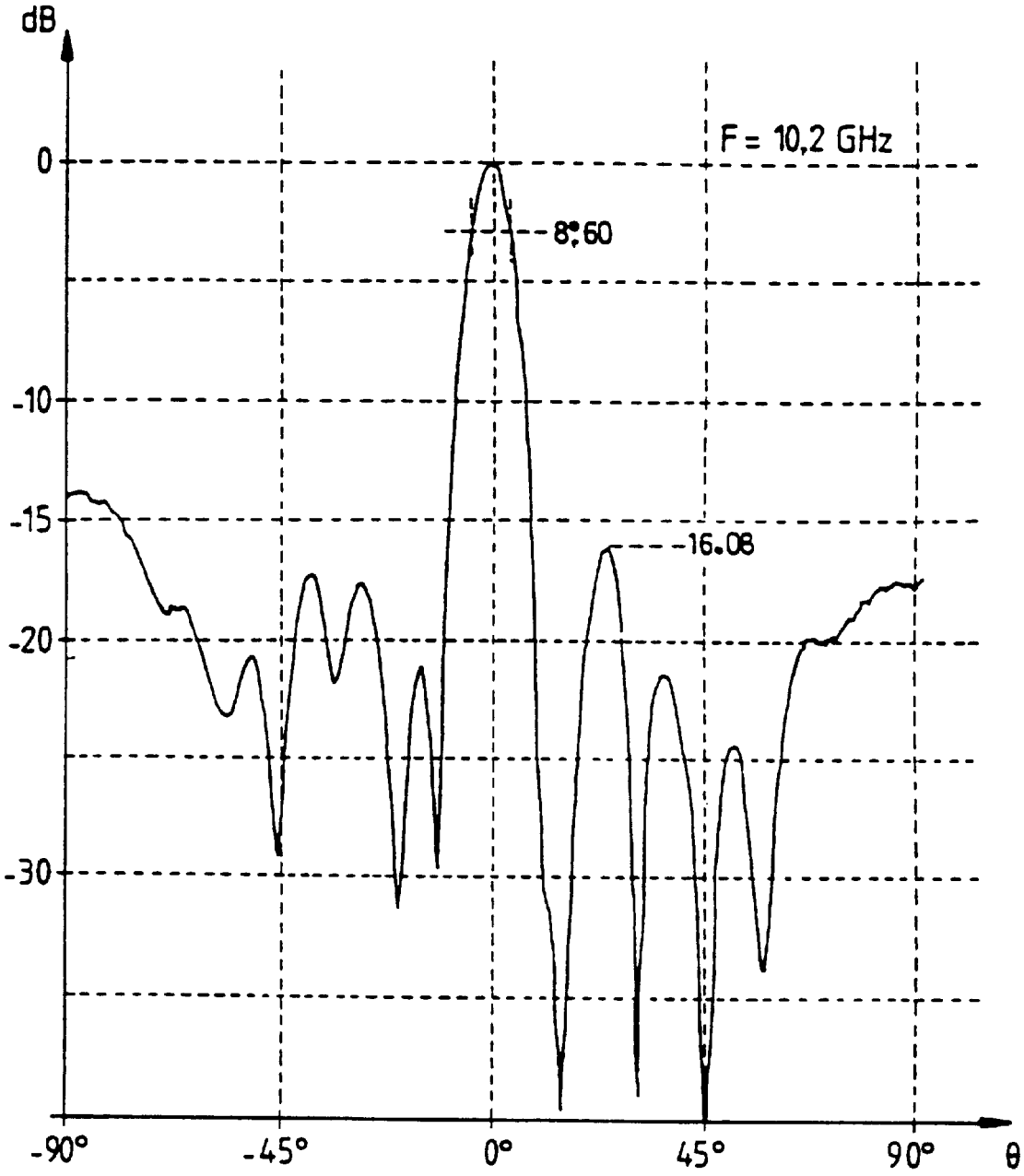
FIGS. 4 and 5 are diagrams illustrating the improvement in the performance by virtue of the nonperiodicity of the patches.

Returning to FIG. 1, the distribution of the patches over the antenna could be periodic as is conventional in array antennas. However, as may be seen in the radiation pattern of FIG. 4 in the plane H (for the highest frequency of the band considered here by way of example), an upturn in the side lobes is observed around ±90°, this being very detrimental.

It is recalled that, in the overall radiation pattern of an antenna, it is possible to define sections through the plane containing the electric field (E plane), through the plane containing the magnetic field (H plane) and through diagonal planes at 45° to the E and H planes (D planes).

According to a characteristic of the invention, to prevent this upturn in the side lobes and to move aside the array lobes, use is made of a non-periodic distribution of the patches 10, 11 in at least one direction of the plane of the antenna. In the example described with the aid of FIG. 1, the periodicity in the E plane is destroyed. Thus, the patches 10 at the centre of the antenna are distributed periodically with a periodicity of 0.8 λ, where λ is the central wavelength of the passband of the antenna, and the patches 11 at the periphery in the direction of the E field have a larger spacing, for example 0.9 λ. Of course, a stepwise growth in the spacing between patches could also be envisaged.

Figure 5:
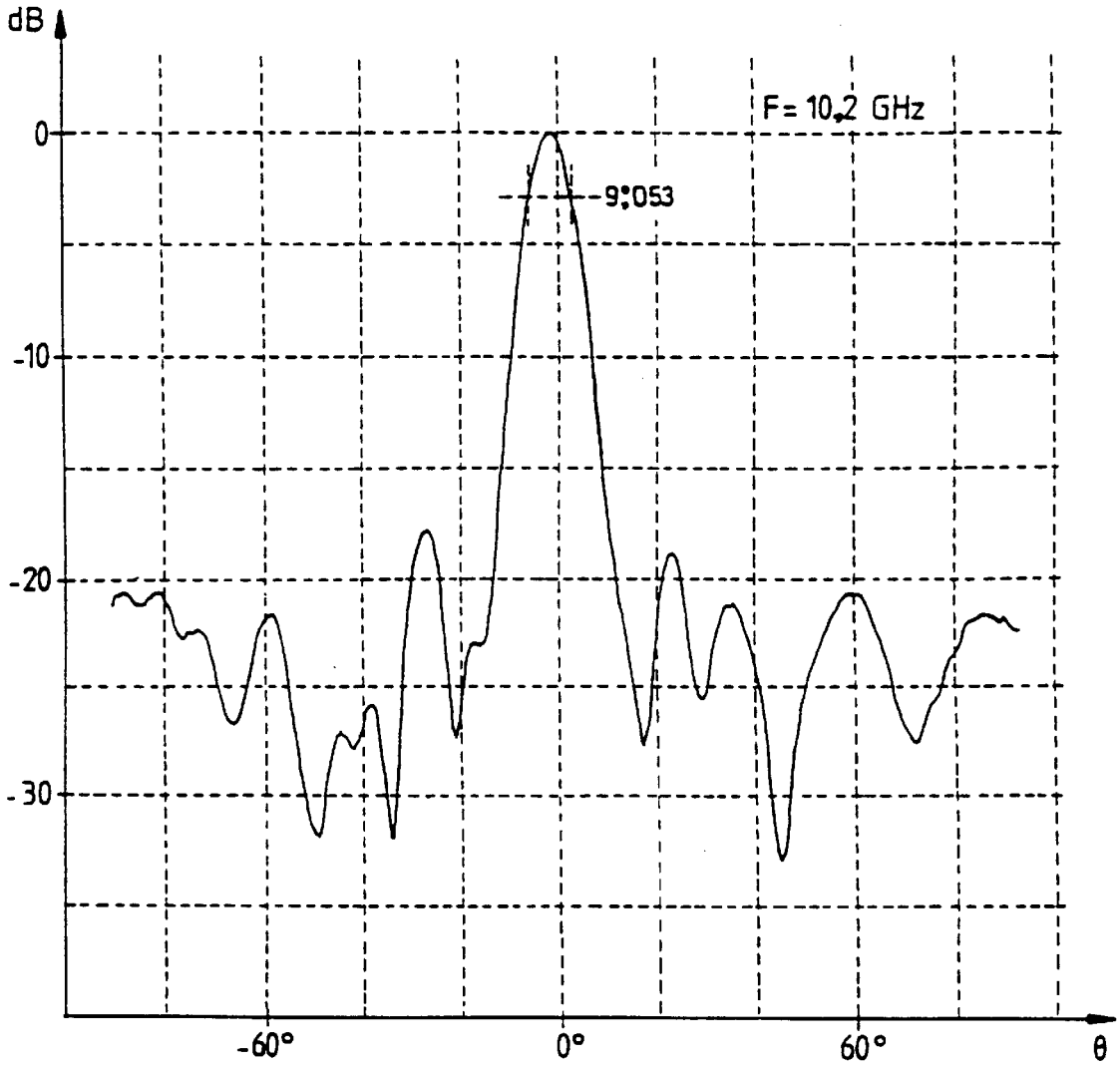

By virtue of the introduction of this nonperiodicity the pattern of FIG. 5 is then obtained in which the detrimental upturns have been eliminated.

Figure 6:
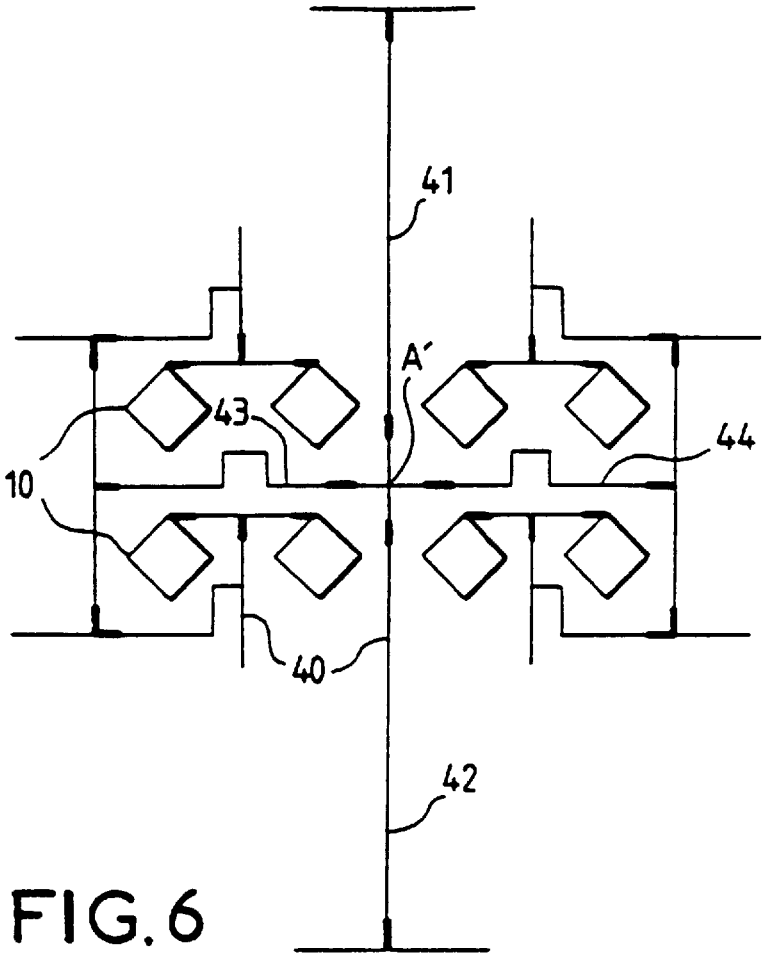
FIG. 6 illustrates a conventional central cross feed of the antenna.
Figure 8:
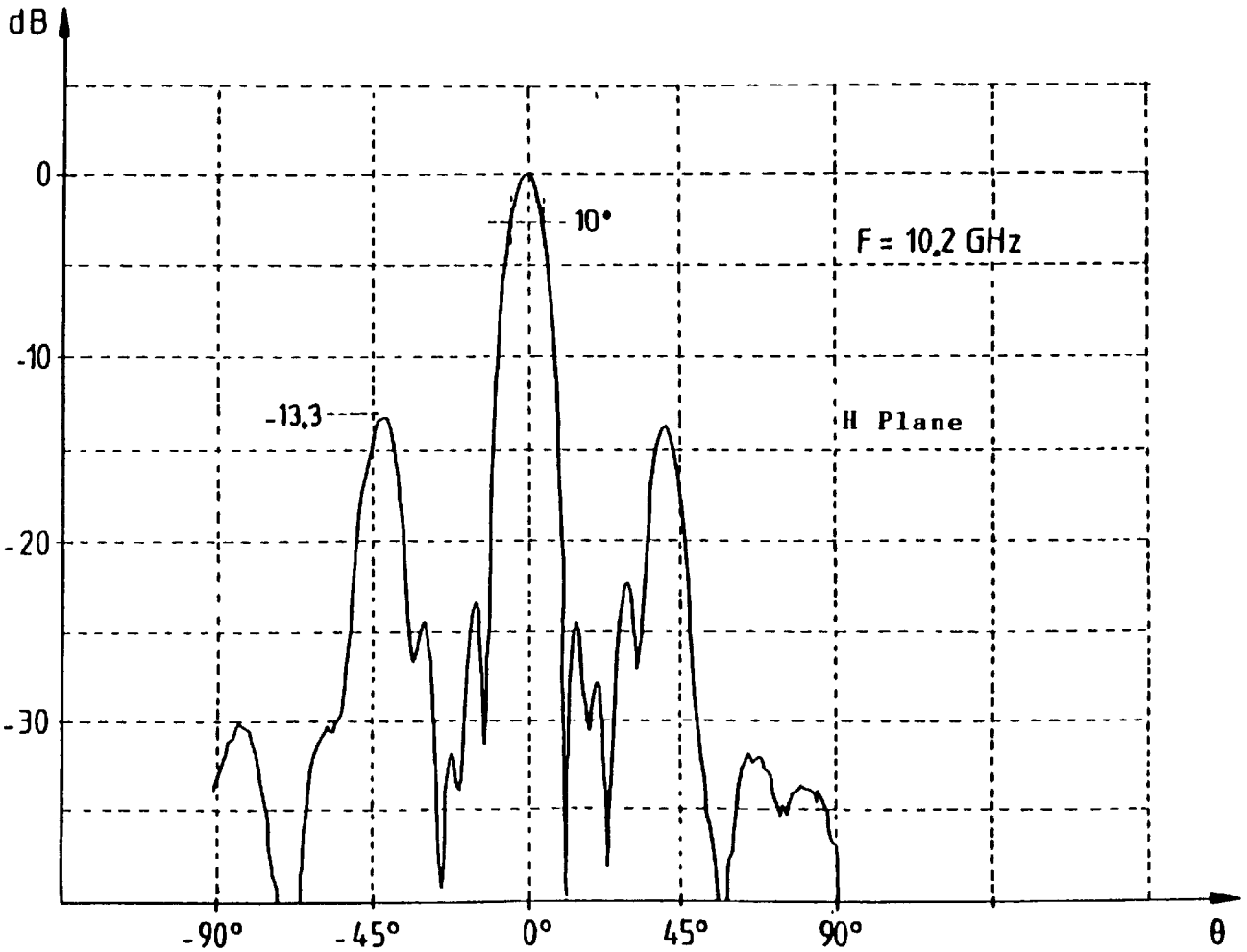
FIGS. 8 and 9 show the radiation pattern in the plane H at the highest frequency, in the case of FIG. 6 and of FIG. 7 respectively.

Another source of disturbance in the radiation pattern resides in the central feeding of the antenna. The immediate solution for going from the coaxial line (not represented) for conveying the signal to the point A with tree-like feeding by the lines 40 is to use the diagram of FIG. 6 with two main lines 41, 42 and 43, 44 crossing at the centre A' of the antenna. Each stretch 41, 44, 42, 43 feeds a successive sector of the antenna about the centre A'. However, a degradation is then noted in the side lobes at ±40°, as may be seen in the pattern at the highest frequency in the H plane of FIG. 8 (upturn rising to around −13 dB). This is very likely due to the parasitic radiation of the cross.

Figure 7:
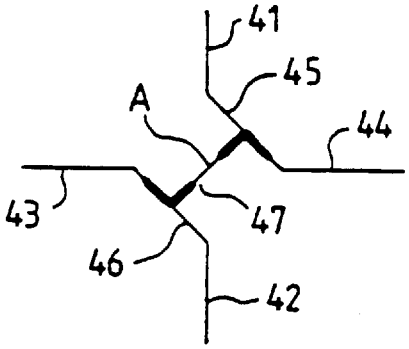
FIG. 7 illustrates the central feed according to the invention.
Figure 9:
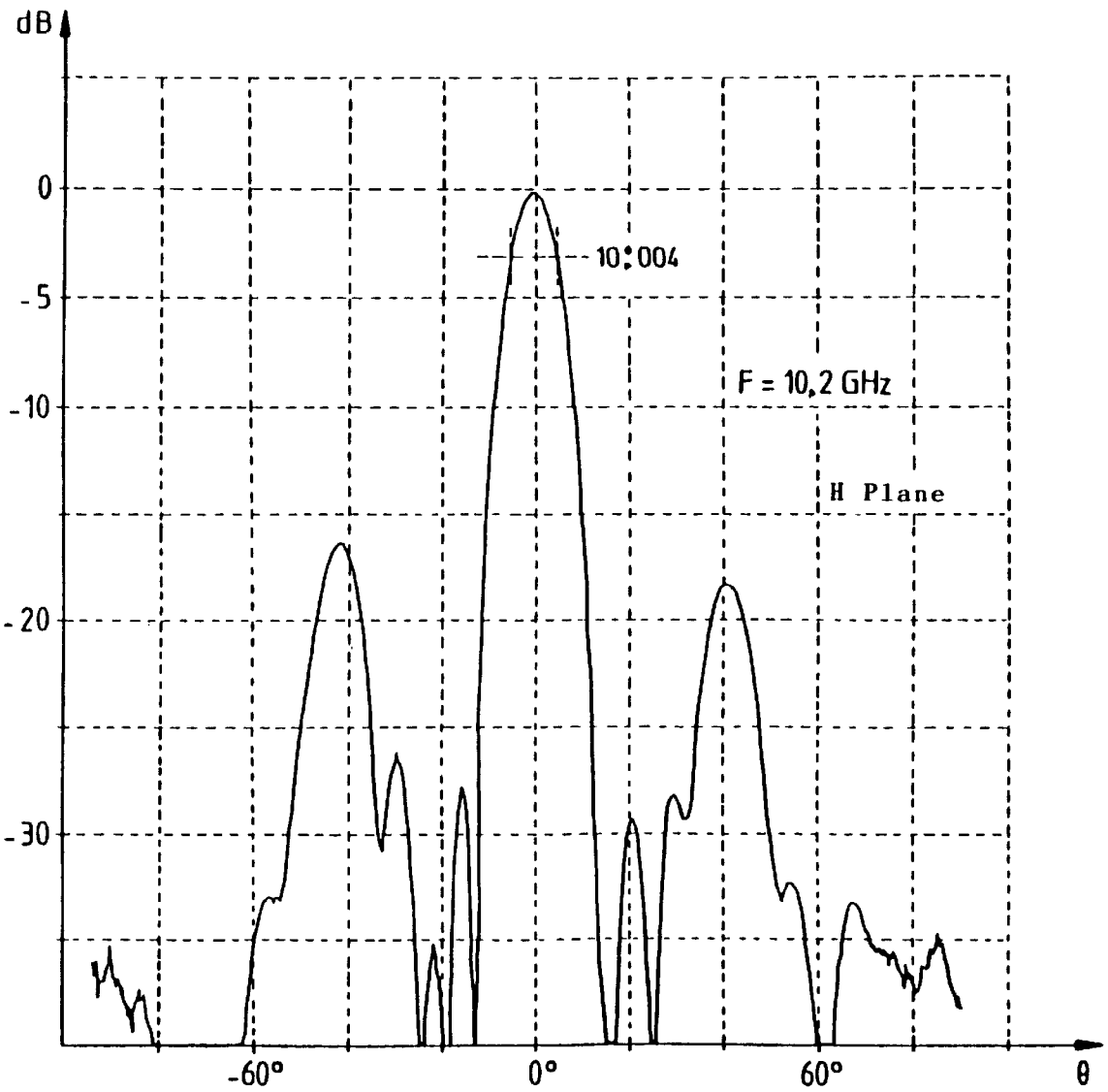

Hence, to remedy this, the geometry of FIG. 7 is adopted. The main feed lines of two successive sectors are linked together by a central line, 45 for lines 41 and 44 and 46 for lines 42 and 43, to form two groups of two successive sectors. A distribution line 47 links the central point A to the lines 45 and 46. This geometry of feed lines considerably reduces the side lobes as may be seen in the pattern of FIG. 9 corresponding to the structure of FIG. 7.

As was mentioned above, for certain applications it is important to obtain an axisymmetric pattern, that is to say one with apertures at 3 dB which are substantially identical for the main lobe in the various planes H, E and D.

In the antenna according to the invention this is obtained by combining the non-periodicity of the patches with suitable weightings applied to the various patches by way of the feed lines 40.

Figure 10:
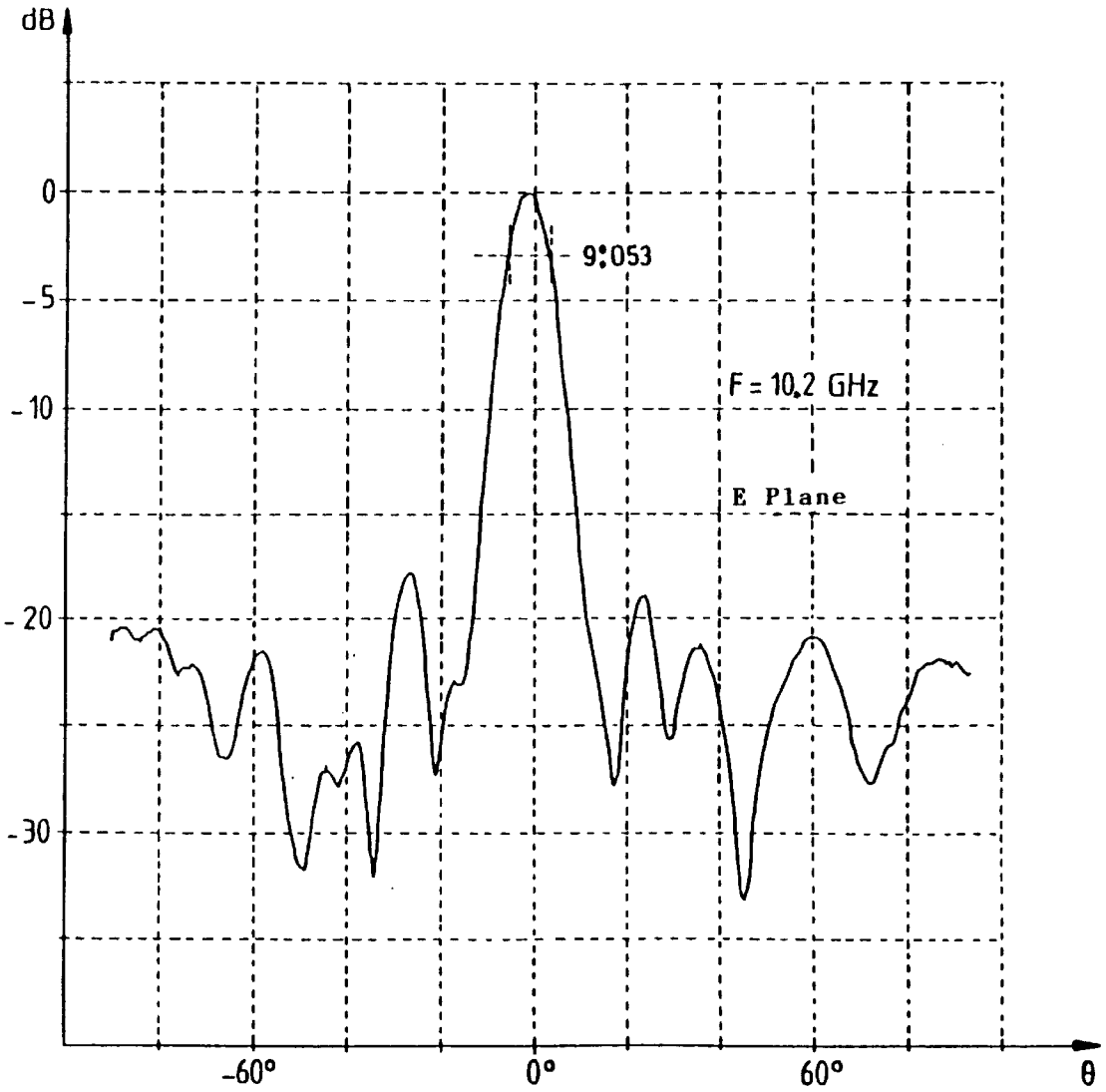
FIGS. 10 and 11 are the patterns in the planes E and D at the highest frequency for the antenna according to the invention.
Figure 11:
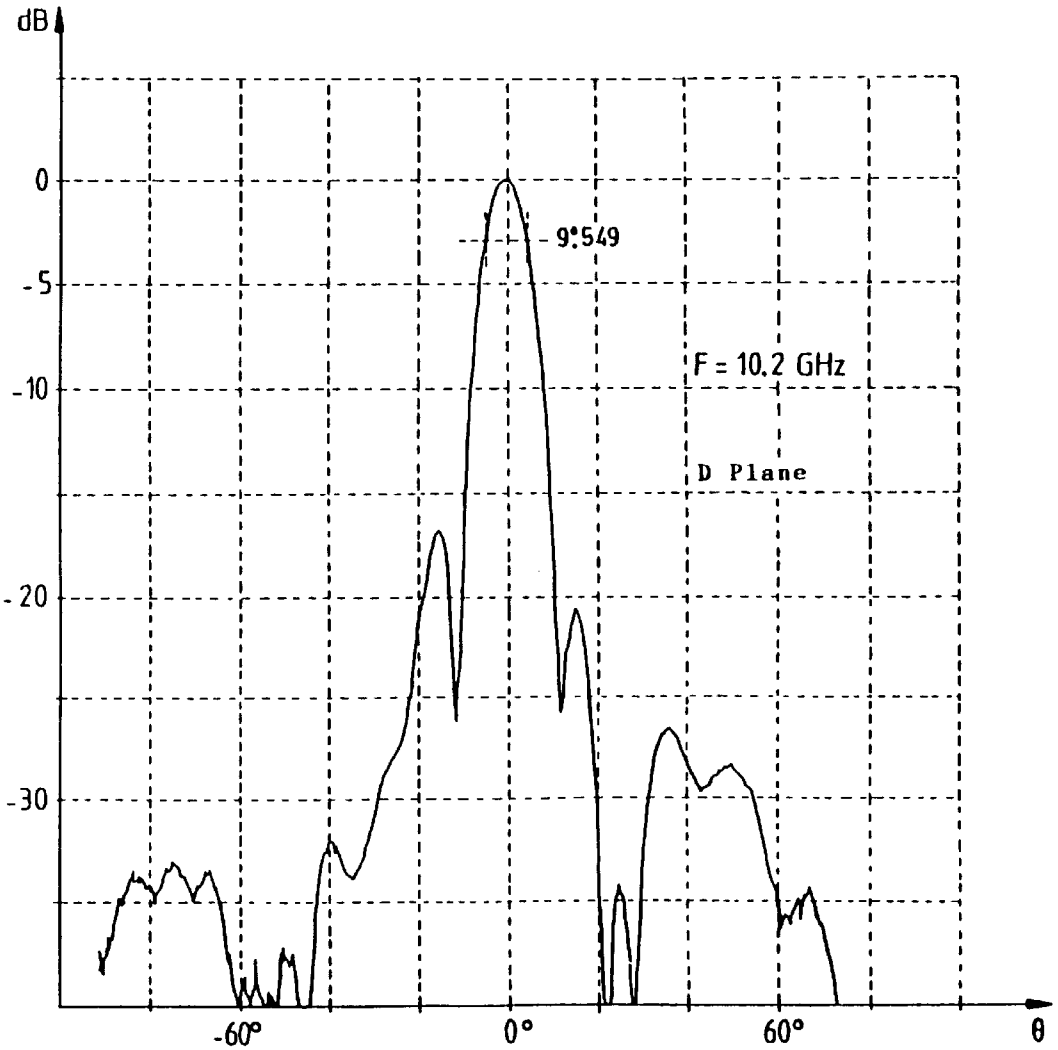
Figure 12:
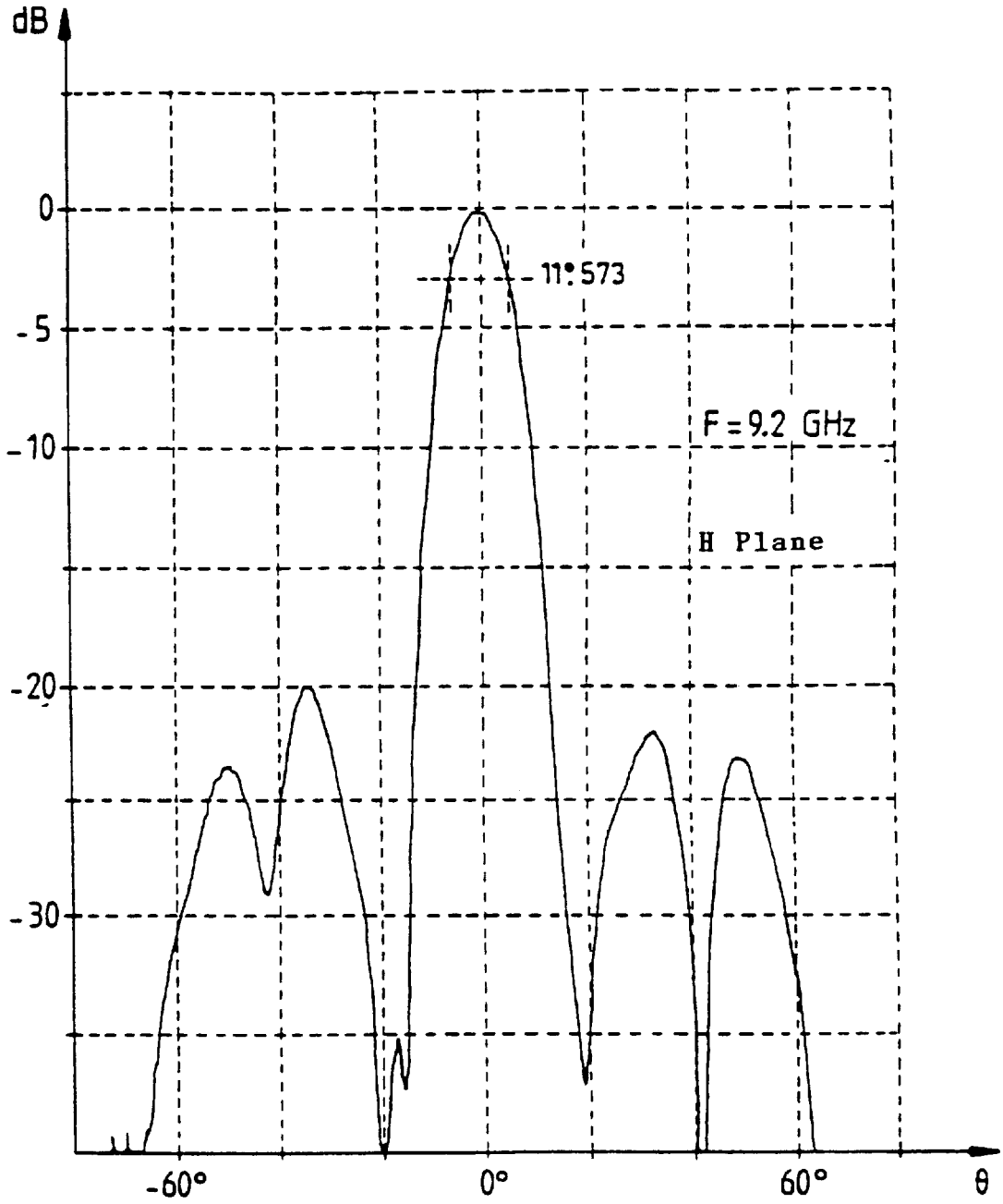
FIGS. 12 to 14 represent the radiation patterns of the antenna according to the invention in the planes H, E and D for the lowest frequency.
Figure 13:
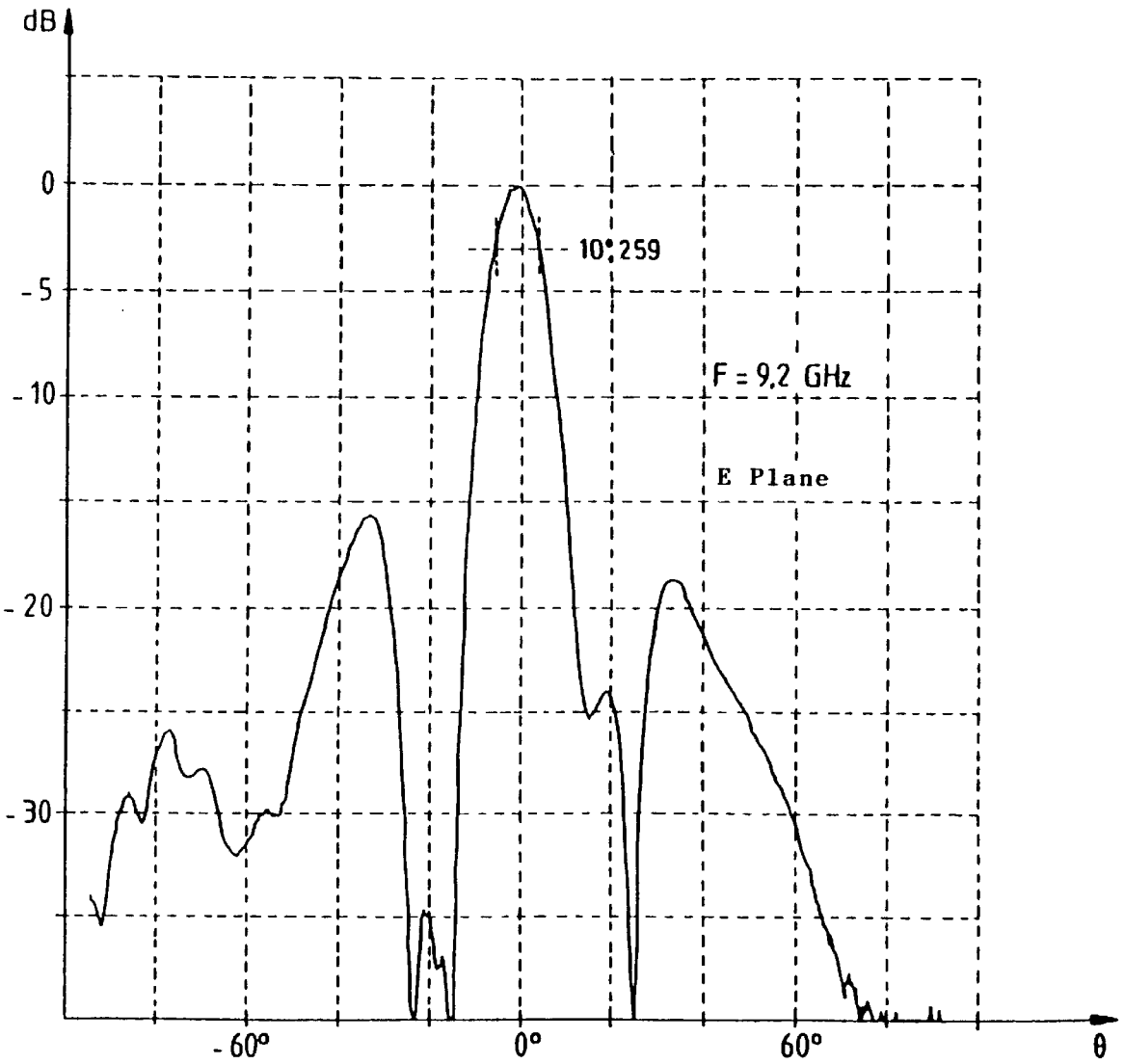
Figure 14:
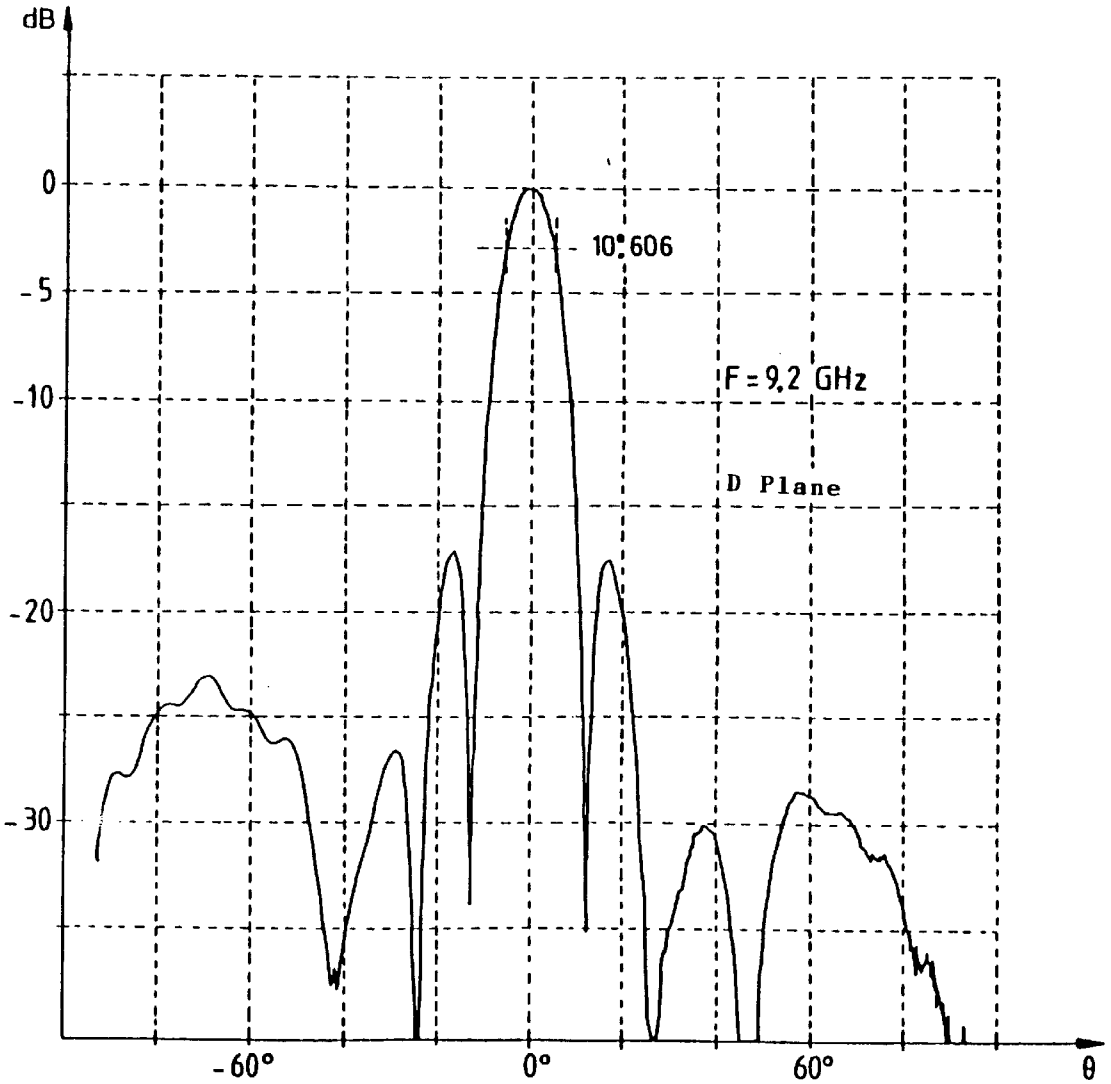

By virtue of this, substantially axisymmetric patterns are obtained throughout the passband of the antenna. This is apparent, for example, for the highest frequency in the patterns of FIGS. 9, 10 and 11 in the planes H, E and D respectively. The same property is noted for the lowest frequency (here 9.2 GHz) in the patterns of FIGS. 12, 13 and 14 in the planes H, E and D respectively.

In all the illustrative cases represented, the level of the side lobes is always below −16 dB.

Thus, by virtue of the characteristics according to the invention, a compact and low-weight array antenna is obtained, with radome protection, a very broad passband (greater than 10% for an SWR <1.5), an axisymmetric radiation pattern and a low level of side lobes. Furthermore, the antenna according to the invention is hardly sensitive to the positioning of the parasitic elements which broaden the passband. Finally, the tree-like feeding of the patches through a corner reduces losses.

Of course, the illustrative embodiment described is in no way limiting of the invention.

We claim:

1. Broadband printed array antenna for delivering a substantially axisymmetric main lobe about an axis passing through the center (A) of the antenna, said antenna comprising a plurality of substantially identical square radiating patches fed by microstrip lines, the feeding by said lines from the center of the antenna being a structure having a tree type feeding pattern and each one of said plurality of patches being fed at a corner by one of said lines, characterized in that the line feeding a patch at a corner partially overlaps said corner, and wherein, in at least one direction of the plane of the antenna, the distribution of said plurality of patches is not periodic so as to limit the side lobes in the radiation pattern of the antenna and to change the position of lobes of the array, wherein ones of said plurality of patches which are positioned near a periphery of the antenna in said at least one direction exhibit a spacing greater than a spacing of remaining ones of said patches positioned away from said periphery of the antenna.

2. Array antenna according to claim 1, characterized in that the said direction is that of the E plane of the antenna.

3. Array antenna according to claim 1, characterized in that the said feed lines are provided so as to weight the energies radiated by each patch in such a way as to deliver a substantially axisymmetric main beam in the said broad band.

4. Array antenna according to claim 1, characterized in that the antenna is divided into two groups of two successive sectors, each sector being fed in a tree-type feeding pattern from a main line and the main lines of the sectors of a group being linked by a central line, and in that the feeding from the centre of the antenna is performed by a distribution line linking the said centre to the said central lines of the two groups.

5. Array antenna according to claim 1, characterized in that it comprises a first dielectric layer, one face of which is covered by an earth plane and the other face of which comprises the said patches and the said feed lines, a dielectric foam layer on the said other face and a second dielectric layer of which the face turned towards the foam layer bears parasitic elements of the same shape as the said patches and opposite the said patches, so as to increase the passband of the antenna.

6. Array antenna according to claim 5, characterized in that the said parasitic elements are of smaller size than the corresponding patches.

7. Array antenna according to claim 5, characterized in that the said second layer is made of epoxy glass so as to serve as a radome for the antenna.

8. Array antenna according to claim 7, characterized in that the said first layer is made from polypropylene and in that the thickness of the said first layer is from three to four times smaller than the thickness of the said dielectric foam layer.

9. Array antenna according to claim 2, characterized in that the said feed lines are provided so as to weight the energies radiated by each patch in such a way as to deliver a substantially axisymmetric main beam in the said broad band.

10. Array antenna according to claim 2, characterized in that the antenna is divided into two groups of two successive sectors, each sector being fed in a tree-like manner from a main line and the main lines of the sectors of a group being linked by a central line, and in that the feeding from the center of the antenna is performed by a distribution line linking the said center to the said central lines of the two groups.

11. Array antenna according to claim 3, characterized in that the antenna is divided into two groups of two successive sectors, each sector being fed in a tree-like manner from a main line and the main lines of the sectors of a group being linked by a central line, and in that the feeding from the center of the antenna is performed by a distribution line linking the said center to the said central lines of the two groups.

12. Array antenna according to claim 2, characterized in that it comprises a first dielectric layer, one face of which is covered by an earth plane and the other face of which comprises the said patches and the said feed lines, a dielectric foam layer on the said other face and a second dielectric layer of which the face turned towards the foam layer bears parasitic elements of the same shape as the said patches and opposite the said patches, so as to increase the passband of the antenna.

13. Array antenna according to claim 3, characterized in that it comprises a first dielectric layer, one face of which is covered by an earth plane and the other face of which comprises the said patches and the said feed lines, a dielectric foam layer on the said other face and a second dielectric layer of which the face turned towards the foam layer bears parasitic elements of the same shape as the said patches and opposite the said patches, so as to increase the passband of the antenna.

14. Array antenna according to claim 4, characterized in that it comprises a first dielectric layer, one face of which is covered by an earth plane and the other face of which comprises the said patches and the said feed lines, a dielectric foam layer on the said other face and a second dielectric layer of which the face turned towards the foam layer bears parasitic elements of the same shape as the said patches and opposite the said patches, so as to increase the passband of the antenna.

15. Array antenna according to claim 6, characterized in that the said second layer is made from epoxy glass so as to serve as a radome for the antenna.

* * * * *

UNITED STATES PATENT AND TRADEMARK OFFICE

CERTIFICATE OF CORRECTION

PATENT NO. : 6,031,491

DATED : February 29, 2000

INVENTOR(S): Jean-Pierre DANIEL et al.

It is certified that an error appears in the above-identified patent and that said Letters Patent is hereby corrected as shown below:

On the Title Page, Item [30] the Foreign Application Priority Data should read as follows:

[30] Foreign Application Priority Data

Dec. 17, 1996 [FR] France.....96 15510

Signed and Sealed this

Tenth Day of April, 2001

*Attest:*

Nicholas P. Godici

NICHOLAS P. GODICI

*Attesting Officer*

*Acting Director of the United States Patent and Trademark Office*